US012129587B2

(12) United States Patent
Carnevale et al.

(10) Patent No.: US 12,129,587 B2
(45) Date of Patent: Oct. 29, 2024

(54) COMBINATION WASHING AND DRYING APPLIANCE HAVING AN AIRFLOW SYSTEM CONTAINED WITHIN AN OUTER TUB

(71) Applicant: WHIRLPOOL CORPORATION, Benton Harbor, MI (US)

(72) Inventors: Matteo Carnevale, Esanatoglia (IT); Massimiliano Daniele, Milan (IT); Leonardo Vitaletti, Castelbellino (IT); Alberto Vitali, Fabriano (IT)

(73) Assignee: Whirlpool Corporation, Benton Harbor, MI (US)

( * ) Notice: Subject to any disclaimer, the term of this patent is extended or adjusted under 35 U.S.C. 154(b) by 775 days.

(21) Appl. No.: 17/315,622

(22) Filed: May 10, 2021

(65) Prior Publication Data

US 2022/0356624 A1 Nov. 10, 2022

(51) Int. Cl.

| | |
|---|---|
| ***D06F 29/00*** | (2006.01) |
| ***D06F 37/30*** | (2020.01) |
| ***D06F 58/26*** | (2006.01) |

(52) U.S. Cl.

CPC ..... *D06F 29/005* (2013.01); *D06F 37/304* (2013.01); *D06F 58/26* (2013.01)

(58) Field of Classification Search

CPC ..... D06F 37/304; D06F 29/005; D06F 58/20
USPC ..... 34/595–610
See application file for complete search history.

(56) References Cited

U.S. PATENT DOCUMENTS

| | | | | |
|---|---|---|---|---|
| 2,892,335 | A | 6/1959 | Gray, Jr. | |
| 2,940,179 | A | 6/1960 | Czech | |
| 2,975,623 | A * | 3/1961 | Eichhorn | D06F 25/00 68/16 |
| 3,006,176 | A | 10/1961 | Behrens | |
| 3,553,850 | A | 1/1971 | Schuurink | |
| 4,338,730 | A | 7/1982 | Tatsumi et al. | |
| 4,665,628 | A | 5/1987 | Clawson | |
| 5,454,171 | A | 10/1995 | Ikeda et al. | |
| 7,228,647 | B2 * | 6/2007 | Hong | D06F 25/00 34/604 |
| 7,921,681 | B2 * | 4/2011 | Lim | D06F 25/00 68/207 |
| 8,042,283 | B2 | 10/2011 | Nakiri | |
| 8,984,692 | B2 * | 3/2015 | Balinski | D06F 33/43 8/149.1 |

(Continued)

FOREIGN PATENT DOCUMENTS

| | | | | |
|---|---|---|---|---|
| EP | 1657349 A2 * | 5/2006 | | D06F 25/00 |
| EP | 3441514 A1 * | 2/2019 | | D06F 29/005 |

(Continued)

*Primary Examiner* — Stephen M Gravini
(74) *Attorney, Agent, or Firm* — Price Heneveld LLP

(57) ABSTRACT

A laundry appliance includes a tub contained within an outer cabinet. A motor assembly is attached to the tub having a first rotor and a second rotor that operate about a common rotational axis. A drum is disposed within the tub and coupled with the first rotor to rotationally operable about the common rotational axis. A blower is coupled to the second rotor and disposed within the tub to rotationally operate about the common rotational axis to deliver process air through an airflow path that includes a processing space defined within the drum. The blower is positioned within a blower housing that is positioned between the tub and the drum.

20 Claims, 11 Drawing Sheets

(56) References Cited

U.S. PATENT DOCUMENTS

| | | | | |
|---|---|---|---|---|
| 9,109,318 | B2 | 8/2015 | Kulkarni et al. | |
| 9,133,575 | B2 * | 9/2015 | Hong | D06F 25/00 |
| 9,765,462 | B2 * | 9/2017 | Park | D06F 58/04 |
| 10,094,065 | B2 * | 10/2018 | Kim | D06F 58/20 |
| 10,513,816 | B2 | 12/2019 | Nakamoto | |
| 11,008,691 | B2 * | 5/2021 | Garnek | D06F 58/02 |
| 2009/0064533 | A1 | 3/2009 | Nakiri | |
| 2013/0031797 | A1 * | 2/2013 | Hong | D06F 58/02 34/73 |
| 2016/0032513 | A1 * | 2/2016 | Kim | D06F 25/00 68/20 |
| 2019/0112742 | A1 | 4/2019 | Yu et al. | |
| 2020/0032445 | A1 | 1/2020 | Lee et al. | |
| 2022/0356624 | A1 * | 11/2022 | Carnevale | D06F 58/26 |
| 2023/0130918 | A1 * | 4/2023 | Vaive | D06F 58/04 68/13 R |

FOREIGN PATENT DOCUMENTS

| | | | |
|---|---|---|---|
| EP | 3701076 | A1 | 9/2020 |
| KR | 20060040513 | A * | 2/2016 |

* cited by examiner

COMBINATION WASHING AND DRYING APPLIANCE HAVING AN AIRFLOW SYSTEM CONTAINED WITHIN AN OUTER TUB

BACKGROUND OF THE DISCLOSURE

The present disclosure generally relates to laundry appliances, and more specifically, to a combination washing and drying appliance having a blower contained between a rotating drum and an outer tub and having an airflow path that is contained within the outer tub.

SUMMARY OF THE DISCLOSURE

According to one aspect of the present disclosure, a laundry appliance includes a tub contained within an outer cabinet. A motor assembly is attached to the tub having a first rotor and a second rotor that operate about a common rotational axis. A drum is disposed within the tub and coupled with the first rotor to rotationally operable about the common rotational axis. A blower is coupled to the second rotor and disposed within the tub to rotationally operate about the common rotational axis to deliver process air through an airflow path that includes a processing space defined within the drum. The blower is positioned within a blower housing that is positioned between the tub and the drum.

According to another aspect of the present disclosure, an airflow system for a laundry appliance includes a tub positioned within an outer cabinet. A drum is positioned within the tub and is rotationally operable within the tub about a rotational axis. A heat exchange system includes a heater. A blower is positioned between the tub and the drum that delivers process air through an airflow path that includes a processing space within the drum. The airflow path is entirely contained within the tub.

According to yet another aspect of the present disclosure, a dehumidification system for an appliance includes a tub that is positioned within an outer cabinet. A drum rotates within the tub about a rotational axis. A blower is disposed between the tub and the drum to operate about the rotational axis and that delivers process air through an airflow path for dehumidifying damp articles contained within a processing space defined within the drum. The blower at least partially cools the process air to remove condensate from the process air. The blower is contained within a blower housing that the airflow path is contained within the tub. A drain system is positioned below the tub. The condensate from the blower is delivered from the blower housing to a fluid outlet located at a lower section of the tub. The fluid outlet places the airflow path in communication with the drain system.

These and other features, advantages, and objects of the present disclosure will be further understood and appreciated by those skilled in the art by reference to the following specification, claims, and appended drawings.

Figure 1:
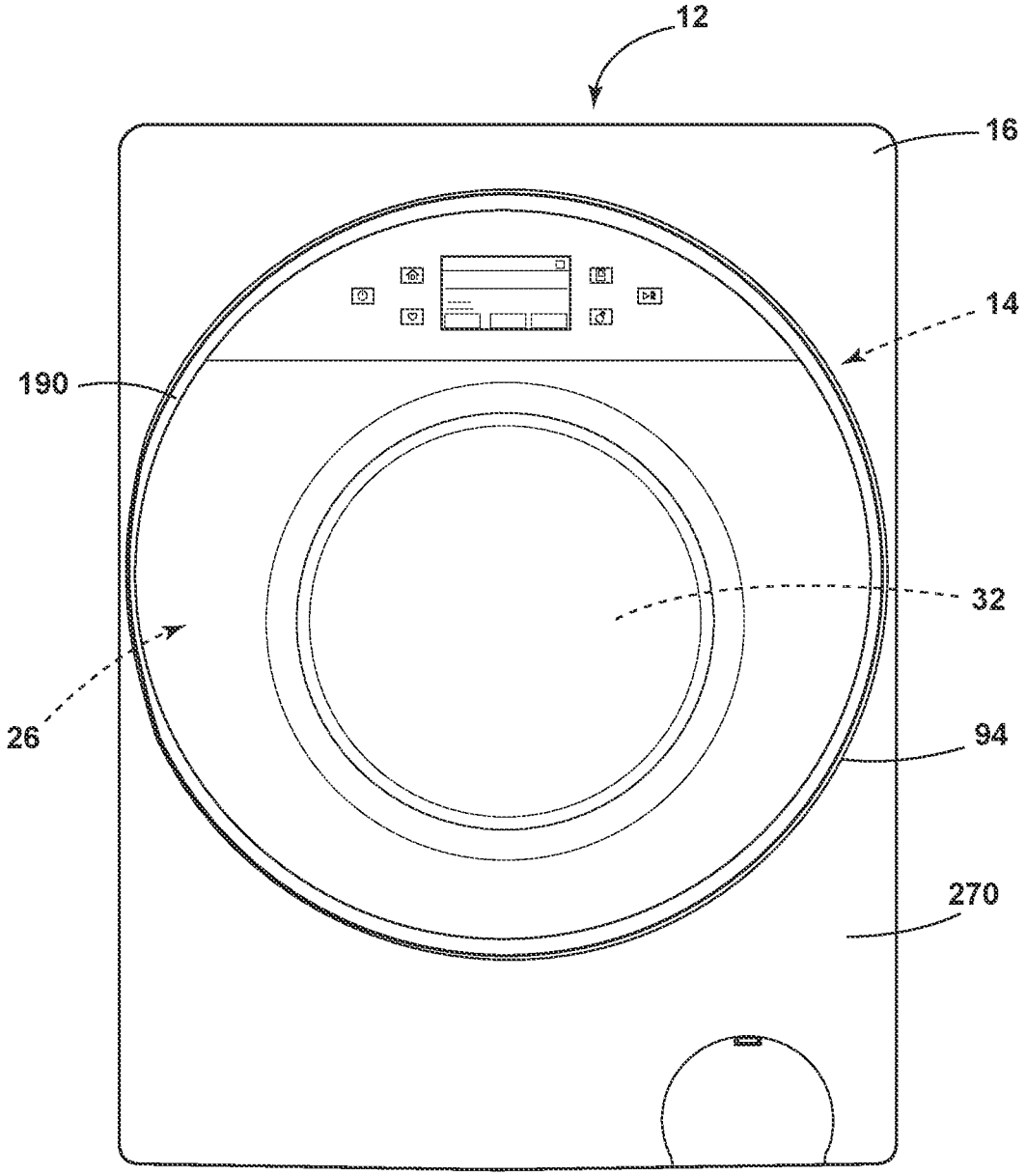
FIG. 1 is a front elevational view of a laundry appliance that incorporates an aspect of an airflow system of the present device.
Figure 2:
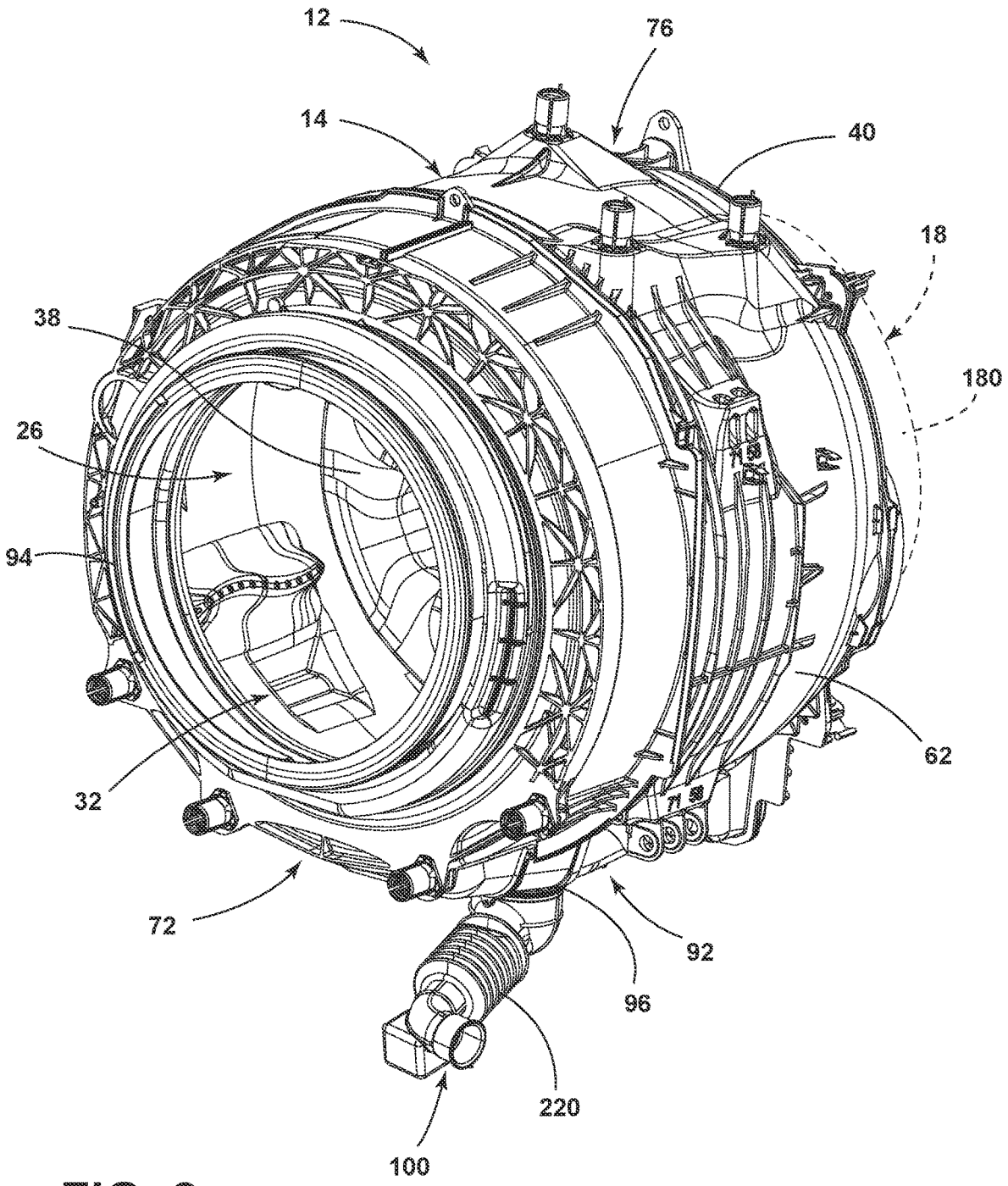
FIG. 2 is a side perspective view of a laundry appliance that incorporates an aspect of the airflow assembly, and shown with the outer cabinet removed.
Figure 3:
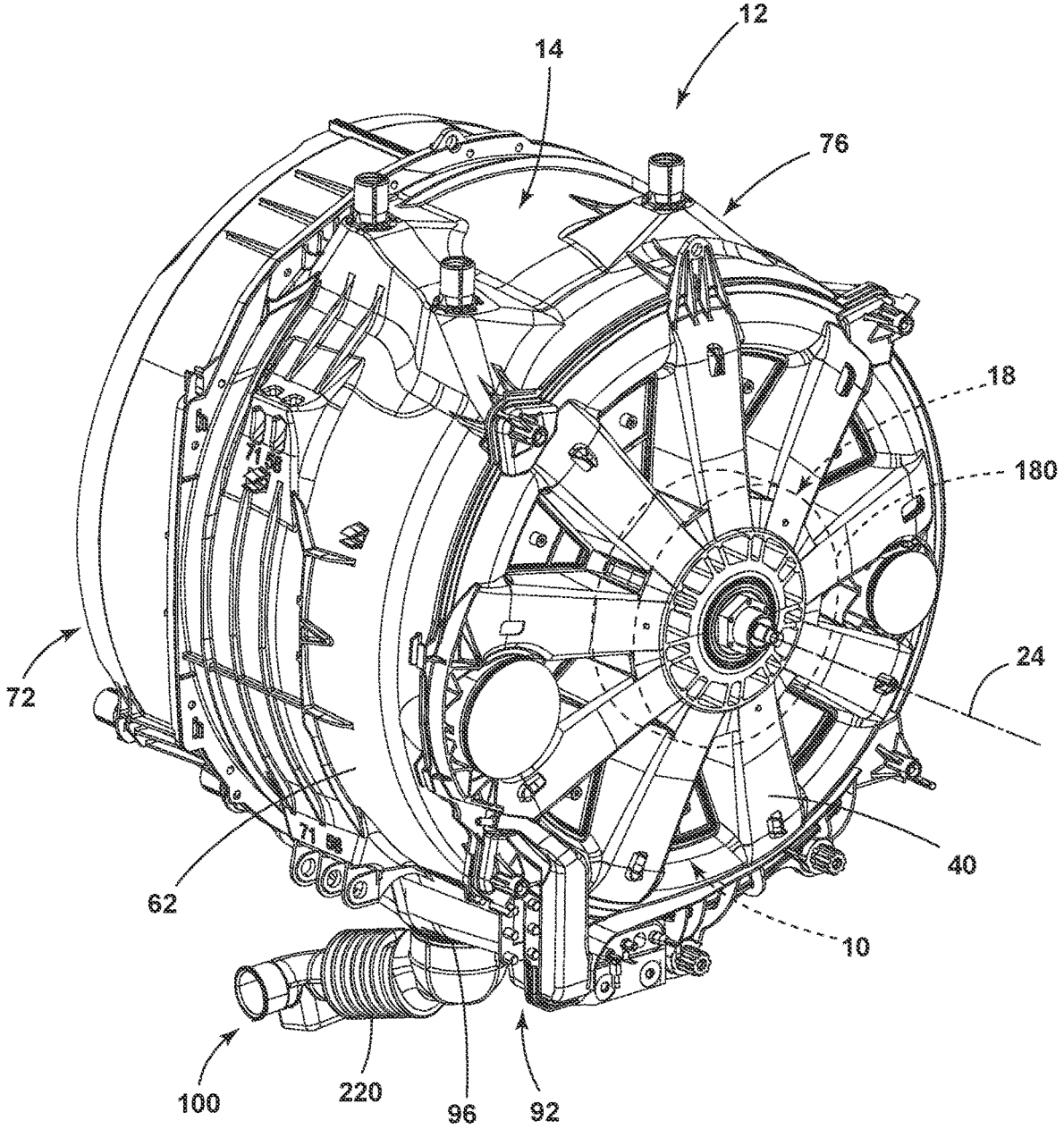
FIG. 3 is a rear perspective view of the laundry appliance of FIG. 2.
Figure 4:
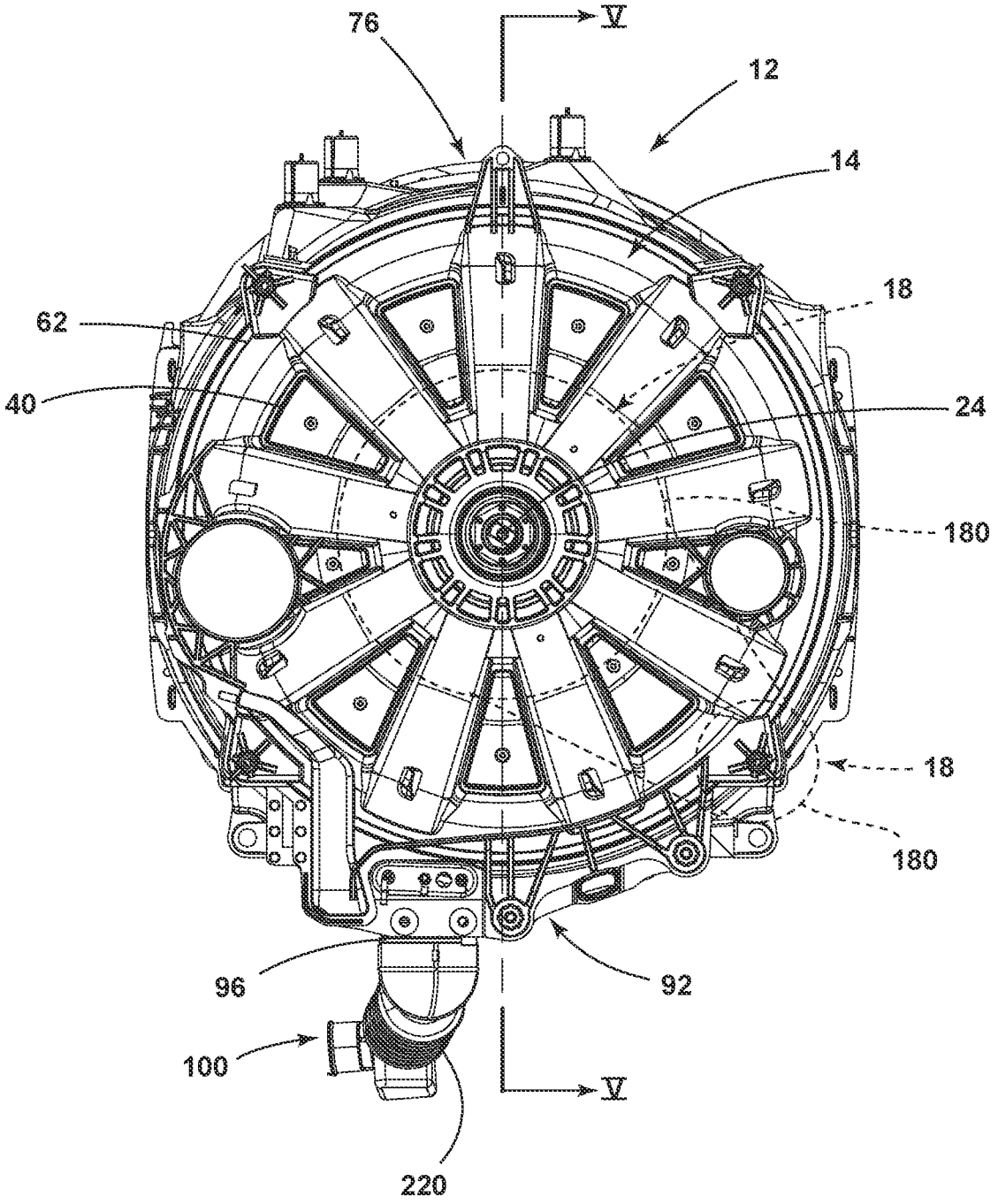
FIG. 4 is a rear elevational view of the laundry appliance of FIG. 2.
Figure 5:
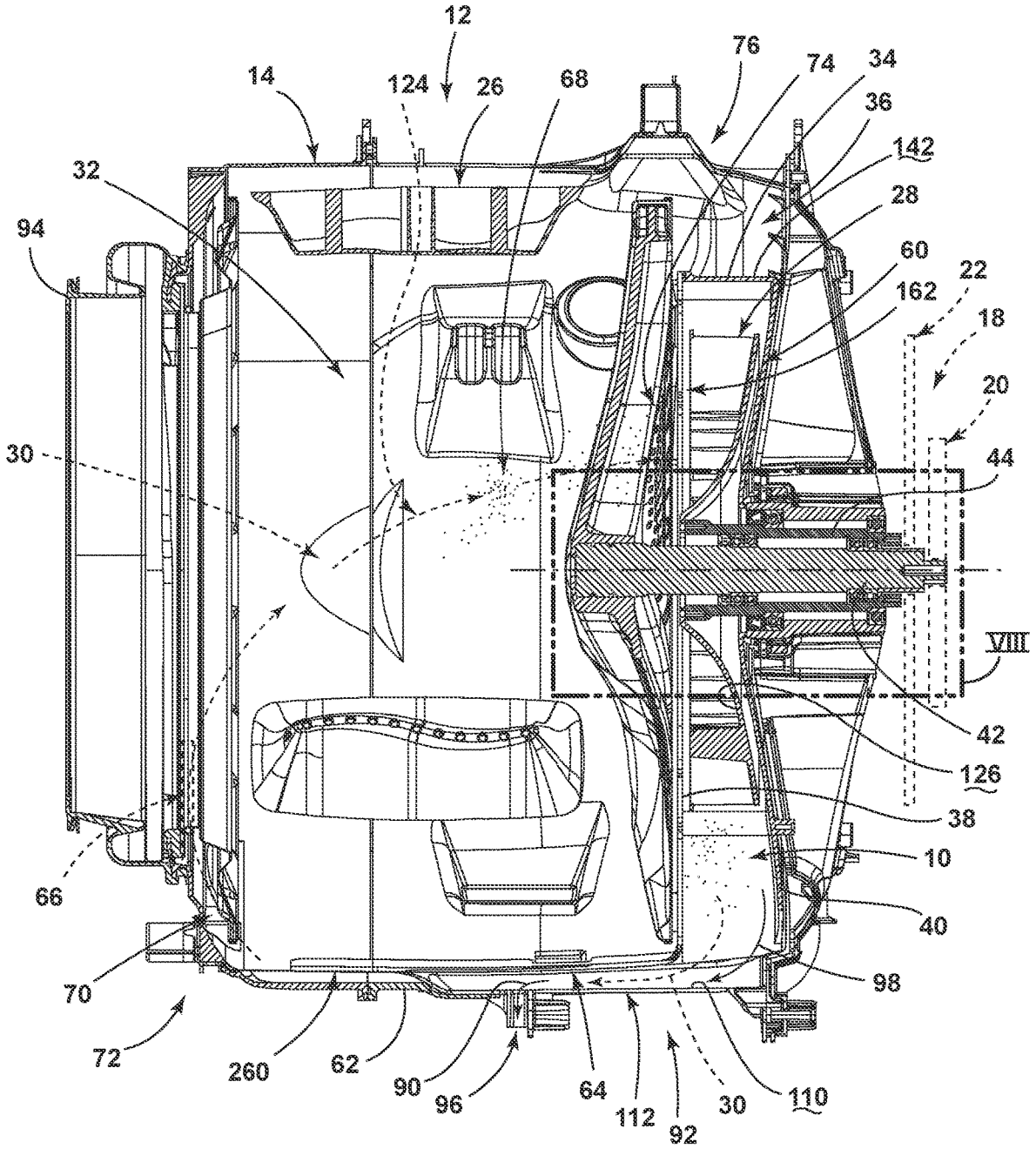
FIG. 5 is a cross-sectional view of the laundry appliance of FIG. 4 taken along line V-V.
Figure 6:
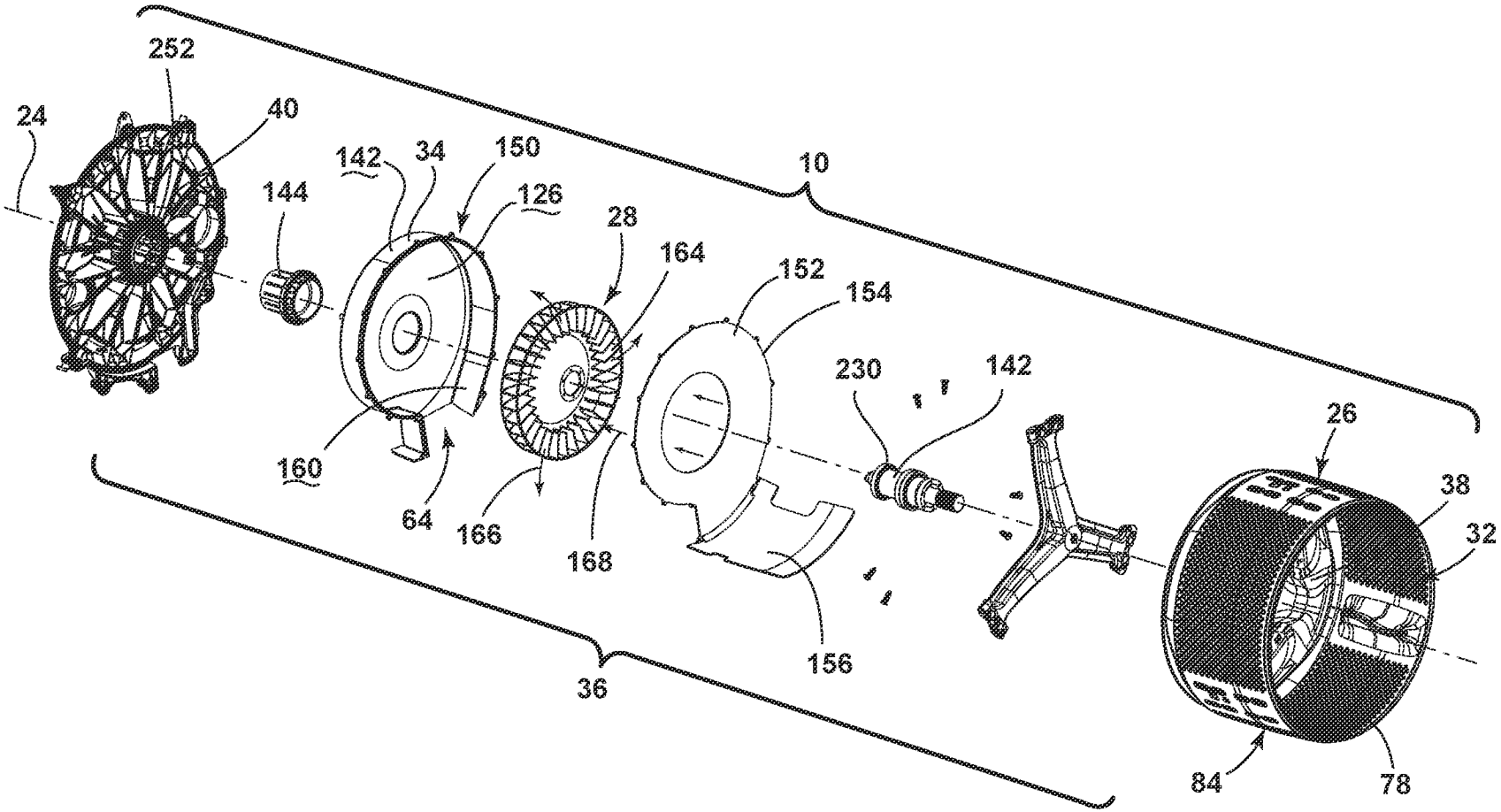
FIG. 6 is an exploded perspective view of the laundry appliance of FIG. 2.
Figure 7:
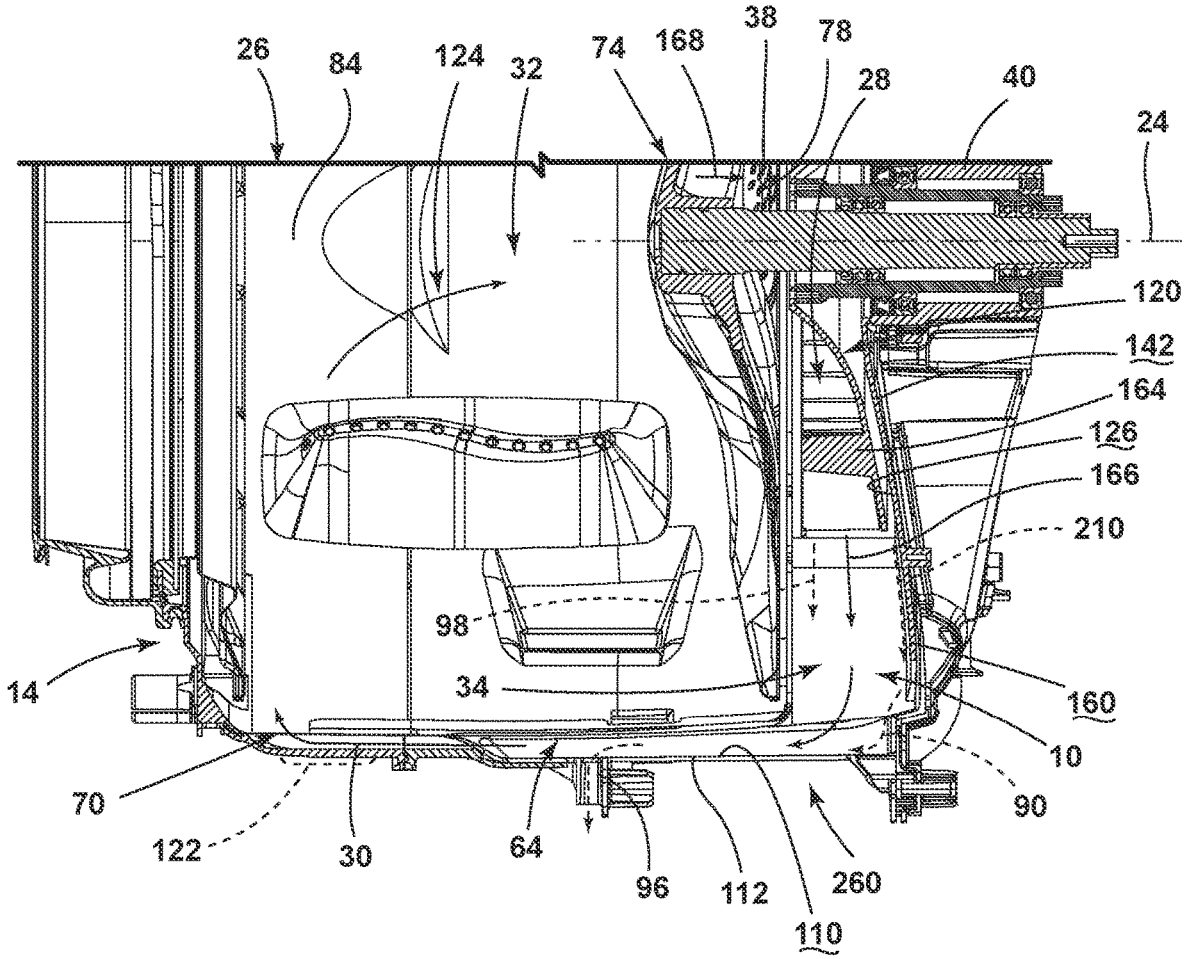
FIG. 7 is an enlarged cross-sectional view of the laundry appliance of FIG. 5 taken at area VII.
Figure 8:
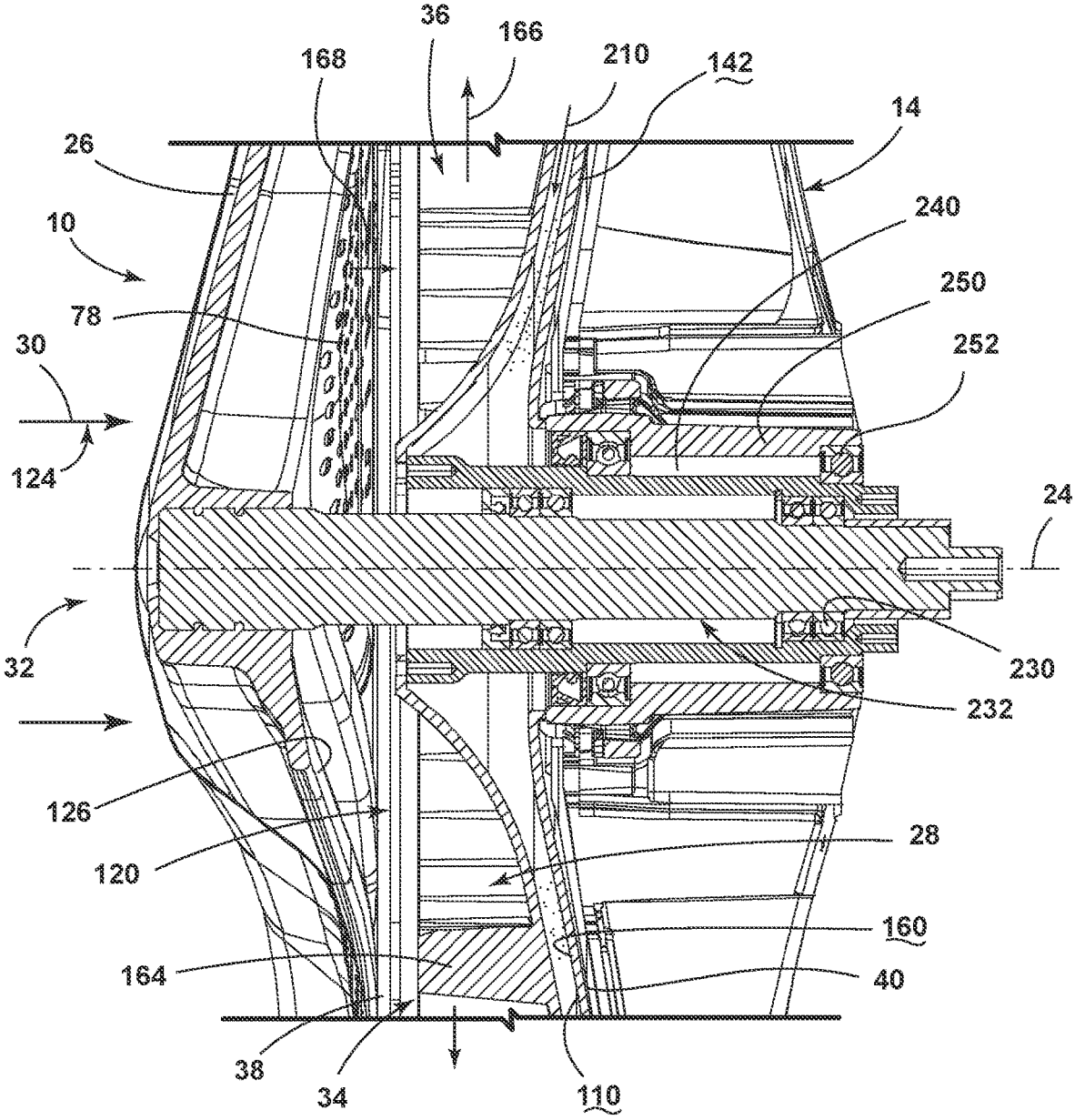
FIG. 8 is an enlarged cross-sectional view of the laundry appliance of FIG. 5 taken at area VIII.
Figure 9:
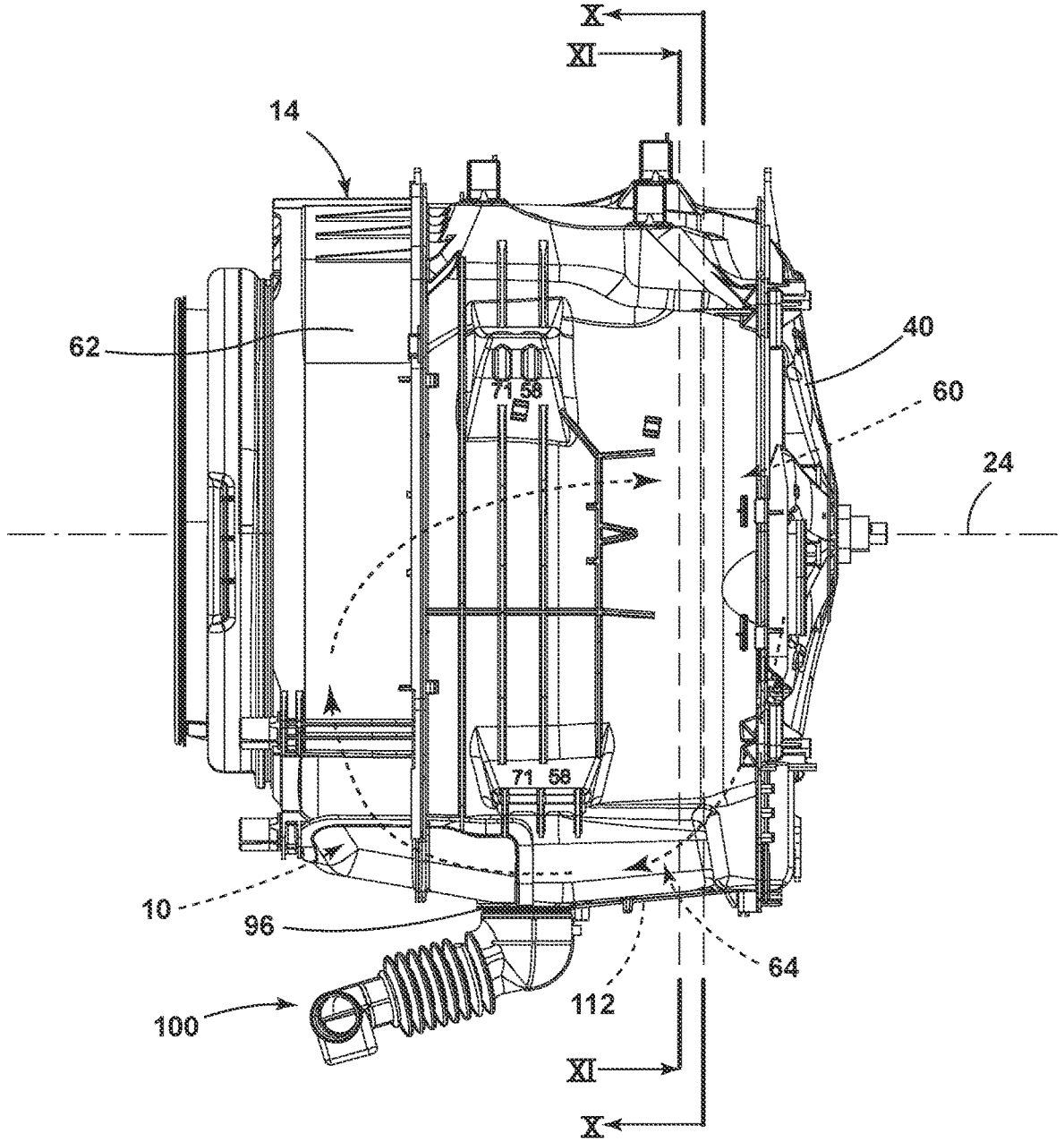
FIG. 9 is a side elevational view of the laundry appliance of FIG. 2.
Figure 10:
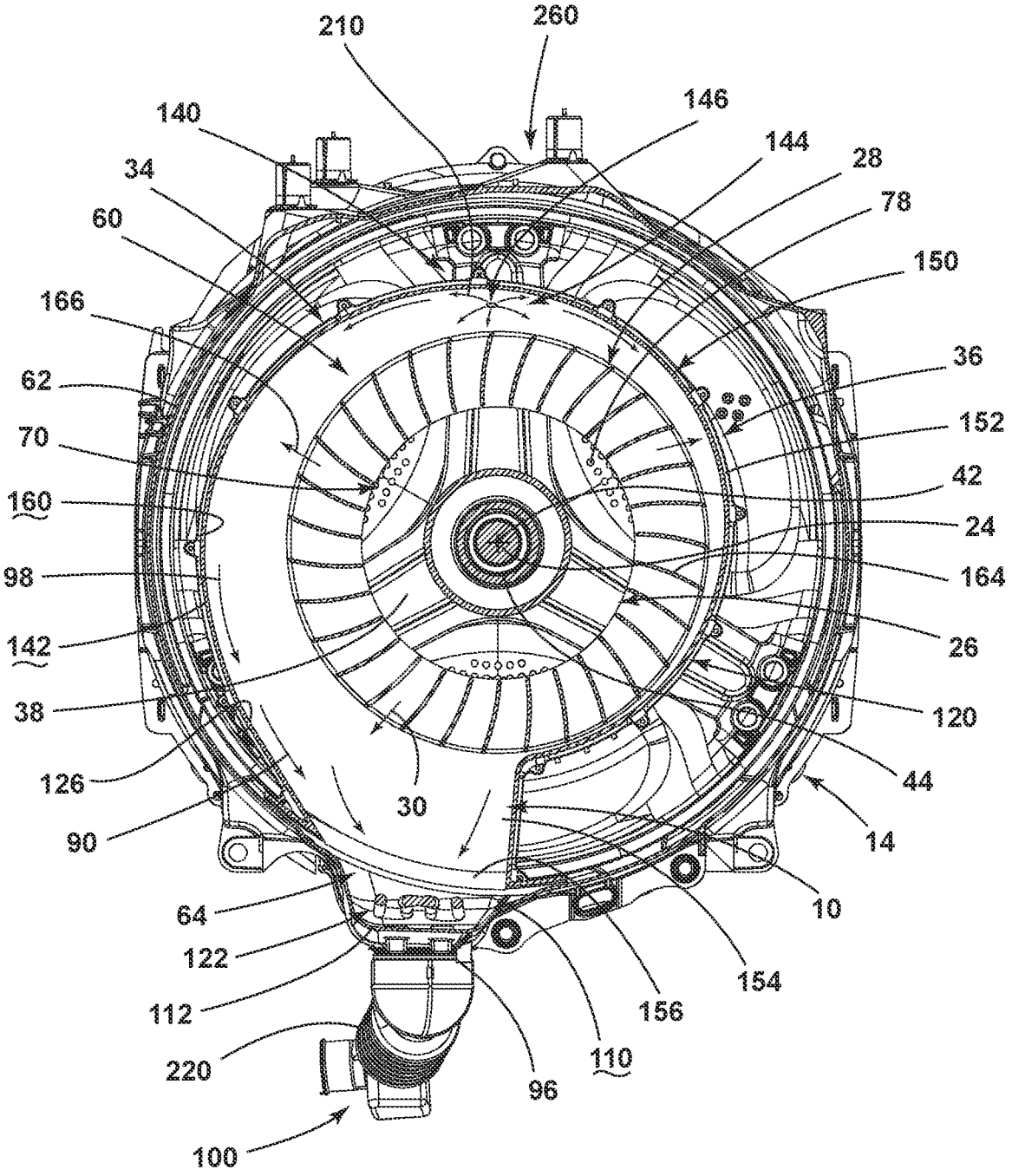
FIG. 10 is a cross-sectional view of the laundry appliance of FIG. 9, taken along line X-X.
Figure 11:
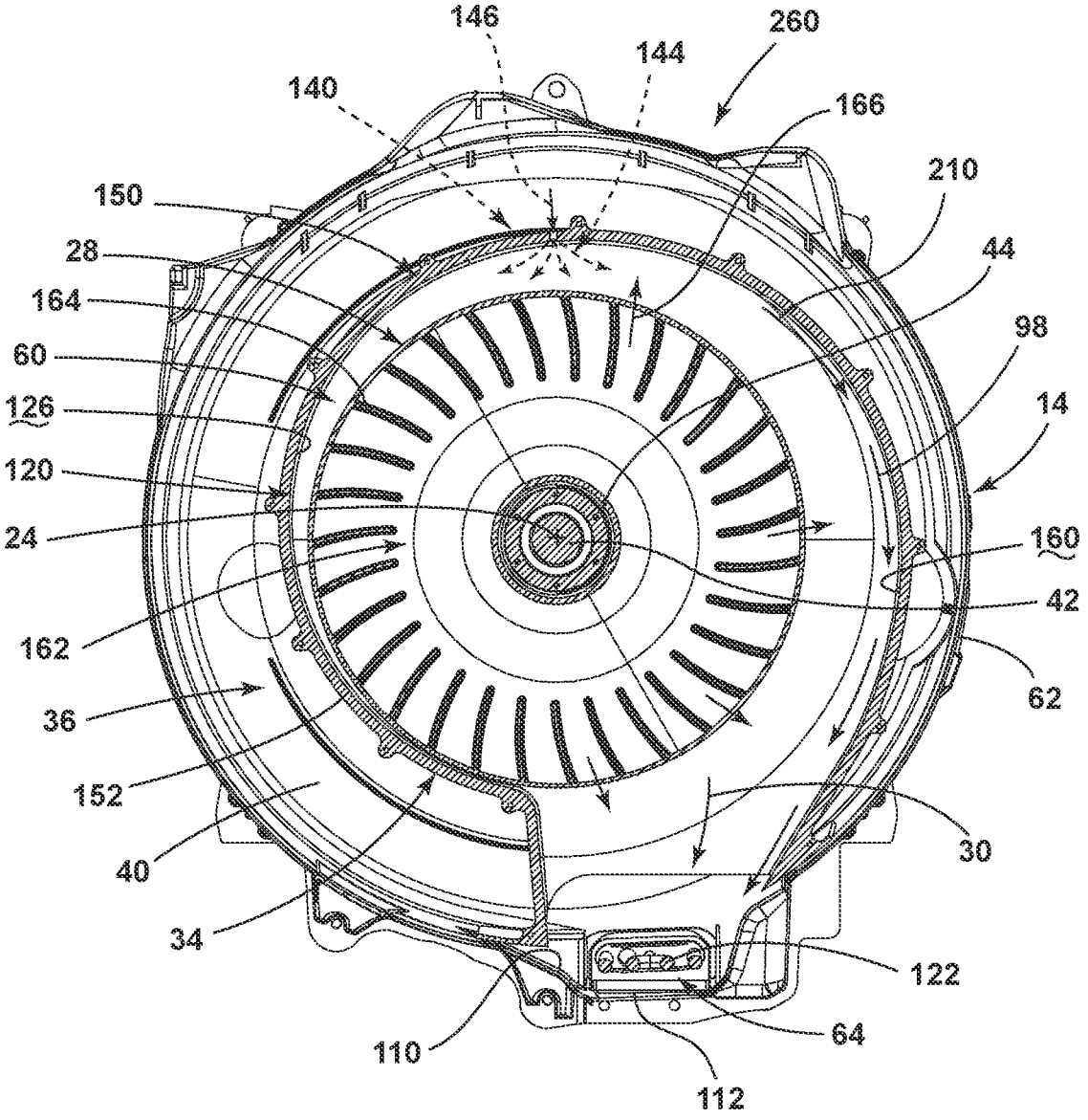
FIG. 11 is a cross-sectional view of the laundry appliance of FIG. 9, taken along line XI-XI.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance having an airflow system that is contained within a tub for the laundry appliance and having a blower that is positioned between the tub and a rotating drum. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-11, reference numeral 10 generally refers to an airflow path for a laundry appliance 12 that is used for providing a dehumidifying and drying function of a combination washing and drying appliance 12. According to various aspects of the device, the laundry appliance 12 includes a tub 14 that is contained within an outer cabinet 16. A motor assembly 18 is attached to the tub 14 and includes a first rotor 20 and a second rotor 22 that operate about a common rotational axis 24. A drum 26 is disposed within the tub 14 that is coupled with the first rotor 20 to rotationally operate about a common rotational axis 24. A blower 28 is coupled to the second rotor 22 and is disposed within the tub 14 to rotationally operate about the common rotational axis 24. In this manner, the blower 28 operates to direct process air 30 through an airflow path 10 that includes a processing space 32 defined within the drum 26. The blower 28 is positioned within a blower housing 34 that is disposed within an interstitial space 36 defined between the tub 14 and the drum 26. More particularly, the interstitial space 36 is defined between a rear wall 38 of the drum 26 and a back wall 40 of the tub 14. In this manner, the first and second rotors 20, 22 can engage a first drive shaft 42 and a second drive shaft 44. Each of the first and second drive shafts 42, 44 extend through the tub 14 for engaging the rotating drum 26 and the blower 28, respectively.

Referring again to FIGS. 2-11, the blower housing 34 cooperates with the blower 28 to define a condensing unit 60 that serves to dehumidify the process air 30 that is directed from the processing space 32 and into the blower housing 34. As discussed herein, the airflow path 10 for the laundry appliance 12 is entirely contained within the structural wall 62 of the tub 14. During operation of the blower 28, process air 30 is delivered from the blower 28 and into an airflow channel 64 that is positioned below the rotating drum 26.

According to various aspects of the device, as the process air 30 moves through the airflow channel 64, it typically engages one or more air filters 66 for separating various particulate matter 68 from the process air 30. The process air 30 that enters into the processing space 32 of the rotating drum 26 through an air inlet 70 can be positioned at various locations around the rotating drum 26. By way of example, and not limitation, the air inlet 70 can be positioned near a front portion 72 of the rotating drum 26, typically near a lower portion of the tub 14. The air inlet 70 can also be defined by perforations 78 defined within a cylindrical wall 84 of the drum 26. Those perforations 78 that generally align with the airflow channel 64 direct the process air 30 from the airflow channel 64, through the perforations 78 and into the processing space 32 of the drum 26. In this manner, as process air 30 enters into the processing space 32, it moves generally upward and through the processing space 32 to engage and dehumidify the damp articles being processed within the processing space 32. The process air 30, after moving through the processing space 32, moves through a return port 74 that extends through or around the rear wall 38 of the drum 26. This return port 74 can be located near a top portion 76 of the interstitial space 36 and typically towards a rear of the rotating drum 26 to be returned to the blower housing 34. In this manner, the process air 30 can be recirculated within the airflow path 10. Again, the airflow path 10 is configured to be contained entirely within the tub 14. As will be described more fully below, the return port 74 can also be defined within perforations 78 defined within the rear wall 38 of the drum 26.

According to various aspects of the device, the airflow path 10 can extend from the blower 28 and the blower housing 34 to the airflow channel 64 below the drum 26, into the processing space 32 and then back to the blower housing 34 via the rear wall 38 of the drum 26. It is also contemplated that other configurations of the airflow path 10 can be incorporated depending on the design of the appliance 12. In at least one aspect, the blower 28 can direct the process air 30 into the processing space 32 via the rear wall 38 of the drum 26, then in a generally downward direction toward the airflow channel 64. From the airflow channel 64 the process air 30 can be moved through a portion of the airflow path 10 below the drum 26 and back to the blower housing 34.

According to the various aspects of the device, combination washing and drying appliances 12 include various washing cycles and drying cycles. During the washing cycles, portions of the tub 14 and rotating drum 26 contain fluid 90 that is used to process the laundry during the washing cycle. In order to contain this fluid 90 within the tub 14, it is necessary to make the lower section 92 of the tub 14 fluid tight or substantially fluid tight. This serves to prevent leakage of the fluid 90 over time, and during the course of the operation of the laundry appliance 12. To maintain this fluid-tight configuration of the tub 14, or at least the lower section 92 of the tub 14, the various aspects of the device, as disclosed herein, provide for the airflow path 10 that is contained entirely within the tub 14. Through this configuration, the structural wall 62 of the tub 14 can be made to be substantially free of openings within a lower section 92 of the structural wall 62 of the tub 14. The only openings that are typically located in this lower section 92 of the tub 14 are a portion of the main access aperture 94 and a fluid outlet 96 that delivers condensate 98 to a drain system 100 for the appliance 12. Minimizing the amount of apertures and other openings within the tub 14 provides for a more watertight configuration of the appliance 12 that limits leakage of process fluid 90 from the tub 14 and to areas outside of the appliance 12.

Referring again to FIGS. 2-11, the laundry appliance 12 includes the drain system 100 that is positioned below the tub 14. The inner surface 110 of the tub 14 defines a drain channel 112 that extends from the blower housing 34 and to the fluid outlet 96. Through this configuration, the drain channel 112 directs this captured condensate 98 from the blower housing 34 and directs this condensate 98 along the lower section 92 of the tub 14 and into the fluid outlet 96 for entering the drain system 100. The lower section 92 of the tub 14 includes a generally sloped configuration that slopes downward toward the fluid outlet 96 so that captured condensate 98 can be delivered, according to the force of gravity, into the drain system 100. In addition, operation of the blower 28, and movement of the process air 30 through the airflow channel 64 of the airflow path 10, can also assist in directing the condensate 98 toward the fluid outlet 96 of the drain system 100. It is contemplated that the drain channel 112 and the airflow channel 64 can be located proximate one another within the interstitial space 36.

Referring again to FIGS. 2-11, the airflow path 10 includes a heat exchange system 120 that includes a heater 122 that is disposed within the airflow path 10. Typically, the heater 122 is positioned upstream of the processing space 32 so that the process air 30 can be heated for entering into the processing space 32 of the drum 26 via the air inlet 70. The blower 28 and the blower housing 34 cooperate to define the condensing unit 60 of the heat exchange system 120. This condensing unit 60 serves to cool and dehumidify the process air 30 after leaving the processing space 32 of the drum 26. Movement of the process air 30 within the blower housing 34 has the effect of extracting moisture 124 from the process air 30 leaving the processing space 32. As the blower 28 operates, this moisture 124 is cooled and forms condensate 98 that can be separated from the process air 30.

This condensate 98 is collected within the blower housing 34 and can be moved in a generally centrifugal fashion toward an interior surface 126 of the blower housing 34. The blower housing 34 is shaped to allow for the movement of this condensate 98, according to the force of gravity, and also according to the process air 30 toward the fluid outlet 96 of the tub 14. According to the various aspects of the device, the blower housing 34 can include a generally cochlear or spiral shape that assists in receiving and moving the process air 30, as well as performing the dehumidifying functions of the condensing unit 60. In addition, the blower housing 34 can include a housing structure 150 that is positioned within the interstitial space 36. The housing structure 150 includes a plurality of housing panels 152 that connect together to surround the blower 28 and also define a portion of the airflow channel 64. In this manner, a portion of the front panel 154 can include a channel cover 156 that extends over the airflow channel 64 and defines and contains a portion of the airflow path 10 below the drum 26. In addition, the plurality of housing panels 152 can define the return port 74 that is defined within the rear wall 38 of the drum 26. The housing panels 152 can also at least partially define the air inlet 70 that is typically disposed proximate the front portion 72 of the interstitial space 36.

According to various aspects of the device, the blower housing 34 can also include a secondary cooling system 140 that provides additional cooling for the condensation unit. This secondary cooling system 140 can be in the form of movement of secondary air around the outer surface 142 of the blower housing 34. It is also contemplated that a thermal exchange media, such as a refrigerant, water or other similar thermal exchange media can be used to cool the condensing unit 60 to further assist the dehumidification of the process air 30 within the blower housing 34.

During operation of a drying function of the laundry appliance 12, the process air 30 leaving the processing space 32 typically includes certain amounts of particulate matter 68, such as lint particles. This particulate matter 68 can be separated from the process air 30 with the condensate 98 during operation of the blower 28 within the blower housing 34. In certain instances, this particulate matter 68 can be entrapped within the condensate 98 during operation of the blower 28. It is contemplated that the moisture-laden particulate matter 68 may accumulate within the blower housing 34. In certain instances, at least a portion of this moisture-laden particulate matter 68 can move, according to the force of gravity, in a generally downward direction toward the fluid outlet 96 of the tub 14. It is also contemplated that a supplemental fluid delivery system 144 can be included within and around the blower housing 34 for moving the condensate 98 and entrapped particulate matter 68 from the blower housing 34 and toward the fluid outlet 96 via the drain channel 112 of the tub 14.

As discussed above, a flow of fluid 90 can be used for cooling the blower housing 34 as well as the condensing unit 60 within which the blower 28 operates. This flow of fluid 90 can also be used for moving entrapped particulate matter 68 from the blower housing 34 and toward the fluid outlet 96. This fluid 90 can be delivered by various sprayers, fluid ports, and other similar fluid flow mechanisms 146 that can inject fluid 90 into the condensing unit 60 contained within the blower housing 34. This flow of fluid 90 can move, along with the condensate 98 and captured particulate matter 68, along the blower housing 34, through the drain channel 112 and into the fluid outlet 96 of the tub 14. This fluid 90 can be recirculated fluid 90 that is captured during a washing cycle or a drying cycle, or can be fluid 90 obtained from a source external to the appliance 12, such as in a faucet or other external source.

Referring again to FIGS. 10 and 11, the blower housing 34 can include a generally spiral or cochlear shape that forms a collection surface 160 along the interior surface 126 of the blower housing 34. This collection surface 160 serves to direct the captured condensate 98 from the blower housing 34, and to the drain channel 112 for ultimate deposition through the fluid outlet 96 of the tub 14. The shape of the blower housing 34 can cooperate with the configuration of certain perforations 78 within the rear wall 38 of the drum 26. These perforations 78 can define the return port 74 that returns the process air 30 for the processing space 32 and into the condensing unit 60 included within the blower housing 34. During operation of the blower 28, the blower 28 rotates to generate a suction through the rear wall 38 of the tub 14 that directs the process air 30 from the processing space 32 and toward an interior section 162 of the blower 28 and the blower housing 34. The blower 28 is typically in the form of a centrifugal fan having a plurality of blades 164 that operate about the rotational axis 24 of the drum 26. During operation of the blower 28, the blower 28 generates the suction to draw the process air 30 away from the drum 26. The blower 28 directs the process air 30 in an outward direction 166, through the blades 164 of the centrifugal fan and against the interior surface 126 or collection surface 160 of the blower housing 34. This movement of the process air 30 away from the drum 26 and through the condensing unit 60 of the blower housing 34 serves to at least partially cool the process air 30 to generate the condensing function of the condensing unit 60. According to various aspects of the device, the centrifugal fan of the blower 28 can include various fan blades 164 that can define an axial component 168 of the blower 28 that assists in drawing the process air 30 away from the processing space 32 of the drum 26 and into the blower housing 34.

Referring again to FIGS. 2-11, the motor assembly 18 can include a single motor 180 having a first stator (not shown) that cooperatively operates with the first rotor 20 and a second stator (not shown) that cooperatively operates with a second rotor 22. In such a configuration, it is contemplated that the first and second stators can be incorporated within a direct drive motor 180 that is attached to the back wall 40 of the tub 14. In addition, the first and second stators can be incorporated within a single belt-drive motor 180, or multiple belt-drive motors 180 that are attached to the first and second rotors 20, 22 via respective first and second belts for operating the rotating drum 26 and the blower 28. The exact configuration of the motor assembly 18 with respect to the first and second rotors 20, 22 can vary depending upon the configuration of the appliance 12 and other considerations related to the design of the particular appliance 12.

Referring again to FIGS. 2-9, the airflow path 10 for the laundry appliance 12 can include at least one air filter 66 that is positioned proximate the access aperture 94 of the outer cabinet 16. An operable door 190 is positioned proximate the access aperture 94 to provide selective access to the processing space 32 of the drum 26. This operable door 190 can also provide access to a lint filter that removes particulate matter 68 from the process air 30 before entering the processing space 32 of the drum 26. One or more lint filters can be positioned along various locations of the airflow path 10. Typically, at least a portion of the particulate matter 68 will be separated from the process air 30 within the condensing unit 60 during operation of the blower 28. According to various aspects of the device, a lint filter can be positioned upstream of the condensing unit 60 for separating the particulate matter 68 before it reaches a condensing unit 60. As discussed herein, particulate matter 68 can be captured within the condensing unit 60 and moved away from the condensing unit 60 and toward the drain channel 112 and the fluid outlet 96 through the use of a fluid carrier 210 of the supplemental fluid delivery system 144, such as water, that is directed through the blower housing 34 and over various surfaces of the condensing unit 60 that may capture a portion of the particulate matter.

Referring again to FIGS. 1-11, an airflow system 260 of the laundry appliance 12 includes the tub 14 that is positioned within the outer cavity. The drum 26 is positioned within the tub 14 and is rotationally operable within the tub 14 about the rotational axis 24. The heat exchange system 120 includes a heater 122 that is positioned in thermal communication with the airflow path 10. The blower 28 is positioned within an interstitial space 36 between the tub 14 and the drum 26. The blower 28 delivers process air 30 through the airflow path 10 that includes the processing space 32 within the drum 26. The airflow path 10 is entirely contained within the tub 14. Accordingly, the number of apertures and other openings within the tub 14 is kept to a minimum to prevent leakage of fluid 90 during operation of the combination washing and drying appliance 12. Typically, such leakage may occur during the washing cycle of the appliance 12 and during a spin function of a drying cycle for the appliance 12.

Referring again to FIGS. 5-11, the blower 28 is contained within the blower housing 34 and cooperates with the blower 28 to define the condensing unit 60 of the heat exchange system 120. This condensing unit 60 dehumidifies the process air 30 that is delivered from the processing space 32. Typically, the process air 30 is delivered through a rear wall 38 of the drum 26 and through various perforations 78 within the rear wall 38 and into the blower housing 34. It is also contemplated that various openings within the drum 26 can be used for moving process air 30 from the processing space 32 and into the condensing unit 60 defined within the blower housing 34. The drain system 100 for the appliance 12 is typically positioned below the tub 14. The inner surface 110 of the tub 14 defines a drain channel 112 that extends from the blower housing 34 and to a fluid outlet 96 that directs condensate 98 from the tub 14 and into the drain system 100. The drain system 100 can include a fluid conduit 220 that extends from the fluid outlet 96 into a fluid pump mechanism (not shown) that can direct the fluid 90 to various locations within the appliance 12 or outside of the appliance 12. These functions can include a disposal pump for moving the captured fluid 90 outside of the appliance 12. The drain system 100 can also include a recirculation system for moving the captured condensate 98 or other fluid 90 through the appliance 12 for additional functions during operation of the appliance 12.

Referring again to FIGS. 1-11, a dehumidification system for the appliance 12 includes the tub 14 that is positioned within the outer cabinet 16. The drum 26 rotates within the tub 14 about the rotational axis 24. The blower 28 also rotates about the rotational axis 24 and is disposed between the tub 14 and the drum 26. The blower 28 operates to deliver process air 30 through the airflow path 10 for dehumidifying damp articles contained within the processing space 32 that is defined within the drum 26. The blower 28 operates to at least partially cool the process air 30. This cooling of the process air 30 serves to remove condensate 98 from the process air 30 within the blower housing 34. This collected condensate 98 can then be moved from the blower housing 34 through the drain channel 112 that is defined within the inner surface 110 of the tub 14. The drain channel 112, in turn, directs the condensate 98, and any of the carrier fluid 90, to the fluid outlet 96 that connects with a fluid conduit 220 for delivery to the drain system 100.

Referring now to FIGS. 4-8, the motor assembly 18 for the appliance 12 includes a first drive shaft 42 that is coupled with the rotating drum 26 and a second drive shaft 44 that is coupled with the blower 28 that rotates within the blower housing 34 for defining a condensation unit. The first drive shaft 42 is typically in the form of a solid shaft that extends from the first rotor 20, through the tub 14 and to the rear wall 38 of the drum 26. Operation of the first rotor 20 rotates the first drive shaft 42 and, in turn, rotates the drum 26 about the rotational axis 24. The second drive shaft 44 is typically a hollow member that extends around the first drive shaft 42. Various bearings 230 are positioned within a bearing space 232 defined between the first and second drive shafts 42, 44 that assist in the contemporaneous rotation of the first and second drive shafts 42, 44 during operation of the appliance 12. The bearings 230 in the bearing space 232 provide for the separate and independent operation of the first and second drive shafts 42, 44 and, in turn, the drum 26 and blower 28, respectively.

The second drive shaft 44 is coupled with the second rotor 22. When the second rotor 22 operates about the rotational axis 24, this, in turn, rotates the blower 28 within the blower housing 34. As discussed herein, as the second rotor 22 rotates about the rotational axis 24, the blower 28 also rotates about the same common rotational axis 24 as that of the rotating drum 26. An outer bearing space 240 is positioned between the second drive shaft 44 and a structural support 250 of the tub 14. The structural support 250 can be in the form of a structural hub that is insert injection molded into the structural wall 62 of the tub 14. In addition, the structural support 250 can be in the form of a reinforced section of the structural wall 62 that is integrally formed within the material of the tub 14. Secondary bearings 252 are positioned within the outer bearing space 240 between the second drive shaft 44 and the tub 14 for allowing independent rotation of the second drive shaft 44 with respect to the tub 14 and also between the first and second drive shafts 42, 44.

According to various aspects of the device, as exemplified in FIGS. 1-11, the airflow system 260 described herein is typically used within a horizontal axis appliance 12 or an angled axis appliance 12 having the operable door 190 positioned within a front wall 270 of the outer cabinet 16. In addition, the airflow system 260 is typically used in combination with a combination washing and drying appliance 12 that utilizes a condensing system for dehumidifying the process air 30 or a heat pump system for dehumidifying process air 30. This combination of washing and drying appliances 12 typically utilize a recirculating airflow path 10 that recirculates the process air 30 through the airflow path 10 to be heated and dehumidified over the course of the drying function of the laundry appliance 12. Because the airflow path 10 is entirely contained within the tub 14, recirculation of the process air 30 occurs entirely within the structural wall 62 of the outer tub 14. As discussed herein, by containing the airflow path 10 within the tub 14, perforations 78, openings and other apertures can be captured to a minimum for limiting the amount of fluid 90 that might escape during operation of the appliance 12. This can serve to minimize any moisture 124 that might collect within the basement of the appliance 12 or within the area surrounding the appliance 12.

According to various aspect of the device, the outer tub 14, the motor assembly 18 and the various components contained within the tub 14, such as the blower 28, the blower housing 34 and the drum 26 can be attached to the outer cabinet 16 via various suspension mechanisms. During operation of the appliance 12, the tub 14 and the features attached thereto may oscillate or otherwise move according to the various forces exerted upon the tub 14, typically in the form of fluid 90 and particles moving within the drum 26 during rotation of the drum 26. Because the airflow path 10 is contained within the tub 14, the airflow path 10 is kept in a stable configuration with respect to the tub 14. Accordingly, the airflow path 10 moves with the tub 14 as the tub 14 oscillates during operation of the appliance 12. Also, additional ducts that might be positioned outside of the tub 14 in a conventional laundry appliance 12 are not typically utilized, thereby minimizing unneeded openings that might otherwise be defined within the tub 14.

According to various aspects of the device, it is contemplated that the airflow system 260 described herein can be utilized within a drying appliance 12 that may not include a separate washing function. In such an aspect of the device, the airflow path 10 can be contained entirely within the tub 14. Accordingly, the size of the cabinet 16 may be decreased as the features used for conditioning and moving the process air 30 are contained within the tub 14 when additional space is left outside of the tub 14 that may be used to diminish the size of the appliance 12.

According to the various aspects of the device, the airflow path 10 that is incorporated within the tub 14 is a self-contained system that is operated through the rotation of the blower 28. This blower 28 is positioned within the blower housing 34 that is incorporated within the interstitial space 36 defined between the rear wall 38 of the drum 26 and the back wall 40 of the tub 14. The operation of the blower 28 serves to recirculate the process air 30 around the drum 26 and through the processing space 32 defined within the drum 26. This configuration of the appliance 12, as discussed herein, creates fewer apertures or other openings within the tub 14 so that water that is contained within the tub 14 during the functions of the combination washing and drying appliance 12 is less likely to leak out of the tub 14. The tub 14 is thereby a more water tight container for holding the fluid 90 used for processing laundry within the processing space 32 of the drum 26.

According to another aspect of the present disclosure, a laundry appliance includes a tub contained within an outer cabinet. A motor assembly is attached to the tub having a first rotor and a second rotor that operate about a common rotational axis. A drum is disposed within the tub and coupled with the first rotor to rotationally operable about the common rotational axis. A blower is coupled to the second rotor and disposed within the tub to rotationally operate about the common rotational axis to deliver process air through an airflow path that includes a processing space defined within the drum. The blower is positioned within a blower housing that is positioned between the tub and the drum.

According to another aspect, the blower housing cooperates with the blower to define a condensing unit that dehumidifies the process air from the processing space.

According to yet another aspect, a drain system is positioned below the tub. An inner surface of the tub defines a drain channel that extends from the blower housing to a fluid outlet that directs condensate from the tub to the drain system.

According to another aspect of the present disclosure, the airflow path includes a heat exchange system that includes a heater that is disposed upstream of the processing space. The blower and the blower housing define a condensing unit of the heat exchange system that cools and dehumidifies the process air after leaving the processing space of the drum.

According to another aspect, the motor assembly includes a single motor having a first stator that cooperatively operates with the first rotor and a second stator that cooperatively operates with the second rotor.

According to yet another aspect, the first and second rotors are incorporated within a direct drive motor of the motor assembly.

According to another aspect of the present disclosure, the blower housing has a generally spiral shape that forms a collection surface. The collection surface directs the condensate from the blower housing to the drain channel.

According to another aspect, the airflow path includes at least one air filter that is positioned proximate a front aperture of the outer cabinet. An operable door is positioned proximate the front aperture to provide selective access to the processing space of the drum.

According to yet another aspect, the blower is a centrifugal fan having a plurality of blades that operate about the rotational axis.

According to another aspect of the present disclosure, the blower includes fan blades that define an axial component of the blower.

According to another aspect, an airflow system for a laundry appliance includes a tub positioned within an outer cabinet. A drum is positioned within the tub and is rotationally operable within the tub about a rotational axis. A heat exchange system includes a heater. A blower is positioned between the tub and the drum that delivers process air through an airflow path that includes a processing space within the drum. The airflow path is entirely contained within the tub.

According to yet another aspect, the blower is contained within a blower housing and cooperates with the blower to define a condensing unit of the heat exchange system that dehumidifies the process air that is delivered from the processing space.

According to another aspect of the present disclosure, a drain system is positioned below the tub. An inner surface of the tub defines a drain channel that extends from the blower housing to a fluid outlet that directs condensate from the tub to the drain system.

According to another aspect, the airflow path includes at least one air filter that is positioned proximate a front aperture of the outer cabinet. An operable door is positioned proximate the front aperture to provide selective access to the processing space of the drum.

According to yet another aspect, a motor assembly includes a single motor having a first stator that cooperatively operates with a first rotor for rotating the drum and a second stator that cooperatively operates with the second rotor for rotating the blower.

According to another aspect of the present disclosure, the blower is a centrifugal fan having a plurality of blades that operate about the rotational axis.

According to another aspect, a dehumidification system for an appliance includes a tub that is positioned within an outer cabinet. A drum rotates within the tub about a rotational axis. A blower is disposed between the tub and the drum to operate about the rotational axis and that delivers process air through an airflow path for dehumidifying damp articles contained within a processing space defined within the drum. The blower at least partially cools the process air to remove condensate from the process air. The blower is contained within a blower housing that the airflow path is contained within the tub. A drain system is positioned below the tub. The condensate from the blower is delivered from the blower housing to a fluid outlet located at a lower section of the tub. The fluid outlet places the airflow path in communication with the drain system.

According to yet another aspect, an inner surface of the tub defines a drain channel that extends from the blower housing to the fluid outlet that directs the condensate from the tub to the drain system.

According to another aspect of the present disclosure, the blower housing has a generally spiral shape that forms a collection surface. The collection surface directs the condensate from the blower housing to the drain channel.

According to another aspect, the airflow path includes a heater that is disposed downstream of the fluid outlet.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a tub contained within an outer cabinet;

a motor assembly attached to the tub having a first rotor and a second rotor that operate about a common rotational axis;

a drum disposed within the tub and coupled with the first rotor to rotationally operate about the common rotational axis; and a blower coupled to the second rotor and disposed within the tub to rotationally operate about the common rotational axis to deliver process air through an airflow path that includes a processing space defined within the drum, wherein the blower is positioned within a blower housing that is positioned between the tub and the drum.

2. The laundry appliance of claim 1, wherein the blower housing cooperates with the blower to define a condensing unit that dehumidifies the process air from the processing space.

3. The laundry appliance of claim 1, further comprising a drain system that is positioned below the tub, wherein an inner surface of the tub defines a drain channel that extends from the blower housing to a fluid outlet that directs condensate from the tub to the drain system.

4. The laundry appliance of claim 1, wherein the airflow path includes a heat exchange system that includes a heater that is disposed upstream of the processing space, wherein the blower and the blower housing define a condensing unit of the heat exchange system that cools and dehumidifies the process air after leaving the processing space of the drum.

5. The laundry appliance of claim 1, wherein the motor assembly includes a single motor having a first stator that cooperatively operates with the first rotor and a second stator that cooperatively operates with the second rotor.

6. The laundry appliance of claim 5, wherein the first and second rotors are incorporated within a direct drive motor of the motor assembly.

7. The laundry appliance of claim 3, wherein the blower housing has a generally spiral shape that forms a collection surface, wherein the collection surface directs the condensate from the blower housing to the drain channel.

8. The laundry appliance of claim 1, wherein the airflow path includes at least one air filter that is positioned proximate a front aperture of the outer cabinet, wherein an operable door is positioned proximate the front aperture to provide selective access to the processing space of the drum.

9. The laundry appliance of claim 1, wherein the blower is a centrifugal fan having a plurality of blades that operate about the common rotational axis.

10. The laundry appliance of claim 1, wherein the blower includes fan blades that define an axial component of the blower.

11. An airflow system for a laundry appliance, the airflow system comprising:

a tub positioned within an outer cabinet;

a drum positioned within the tub and rotationally operable within the tub about a rotational axis;

a heat exchange system that includes a heater; and a blower positioned between the tub and the drum that delivers process air through an airflow path that includes a processing space within the drum, wherein the airflow path is entirely contained within the tub.

12. The airflow system of claim 11, wherein the blower is contained within a blower housing and cooperates with the blower to define a condensing unit of the heat exchange system that dehumidifies the process air that is delivered from the processing space.

13. The airflow system of claim 12, further comprising a drain system that is positioned below the tub, wherein an inner surface of the tub defines a drain channel that extends from the blower housing to a fluid outlet that directs condensate from the tub to the drain system.

14. The airflow system of claim 11, wherein the airflow path includes at least one air filter that is positioned proximate a front aperture of the outer cabinet, wherein an operable door is positioned proximate the front aperture to provide selective access to the processing space of the drum.

15. The airflow system of claim 11, wherein a motor assembly includes a single motor having a first stator that cooperatively operates with a first rotor for rotating the drum and a second stator that cooperatively operates with a second rotor for rotating the blower.

16. The airflow system of claim 11, wherein the blower is a centrifugal fan having a plurality of blades that operate about the rotational axis.

17. A dehumidification system for an appliance, the dehumidification system comprising:

a tub that is positioned within an outer cabinet;

a drum that rotates within the tub about a rotational axis;

a blower disposed between the tub and the drum to operate about the rotational axis and that delivers process air through an airflow path for dehumidifying damp articles contained within a processing space defined within the drum, wherein the blower at least partially cools the process air to remove condensate from the process air, wherein the blower is contained within a blower housing, and wherein the airflow path is contained within the tub; and a drain system positioned below the tub, wherein the condensate from the blower is delivered from the blower housing to a fluid outlet located at a lower section of the tub, wherein the fluid outlet places the airflow path in communication with the drain system.

18. The dehumidification system of claim 17, wherein an inner surface of the tub defines a drain channel that extends from the blower housing to the fluid outlet that directs the condensate from the tub to the drain system.

19. The dehumidification system of claim 18, wherein the blower housing has a generally spiral shape that forms a collection surface, wherein the collection surface directs the condensate from the blower housing to the drain channel.

20. The dehumidification system of claim 17, wherein the airflow path includes a heater that is disposed downstream of the fluid outlet.

* * * * *